US007140164B2

(12) United States Patent
Fietkau

(10) Patent No.: US 7,140,164 B2
(45) Date of Patent: Nov. 28, 2006

(54) METHOD OF AND APPARATUS FOR APPLYING ADHESIVE TO RUNNING WEBS OF PAPER AND THE LIKE

(75) Inventor: Stefan Fietkau, Westerau (DE)

(73) Assignee: Hauni Maschinenbau Aktiengesellschaft, Hamburg (DE)

( * ) Notice: Subject to any disclaimer, the term of this patent is extended or adjusted under 35 U.S.C. 154(b) by 74 days.

(21) Appl. No.: 09/875,294

(22) Filed: Jun. 7, 2001

(65) Prior Publication Data

US 2002/0023655 A1 Feb. 28, 2002

(30) Foreign Application Priority Data

Jun. 8, 2000 (DE) ..... 100 27 955

(51) Int. Cl.
*B65B 61/00* (2006.01)
*B31C 13/00* (2006.01)
*B31B 1/62* (2006.01)

(52) U.S. Cl. ..... 53/377.4; 493/39; 493/128; 493/130; 493/264

(58) Field of Classification Search ..... 493/131, 493/128, 130, 264, 39; 53/370.3, 376.6, 53/377.4, 383.1
See application file for complete search history.

(56) References Cited

U.S. PATENT DOCUMENTS 3,971,695 A * 7/1976 Block ..... 156/461
3,974,007 A 8/1976 Greve
4,020,751 A * 5/1977 Greve et al. ..... 493/41
4,031,854 A * 6/1977 Sprague, Jr. ..... 118/641
4,100,845 A * 7/1978 Korber ..... 493/44
4,265,255 A 5/1981 Helms
4,281,670 A 8/1981 Heitmann et al.
4,412,505 A * 11/1983 Hausler et al. ..... 118/674
4,486,186 A * 12/1984 Grumer ..... 493/4
4,511,420 A * 4/1985 Arthur ..... 156/356
4,889,140 A 12/1989 Lorenzen et al.
4,957,783 A * 9/1990 Gabryszewski ..... 427/424
RE33,481 E * 12/1990 Ziecker et al. ..... 239/298
4,983,109 A * 1/1991 Miller et al. ..... 425/7
4,987,854 A * 1/1991 Hall ..... 118/679

(Continued)

FOREIGN PATENT DOCUMENTS

DE 31 43 526 6/1982

(Continued)

OTHER PUBLICATIONS

XP 000549202 "37936 Application of Glue to a Running Web" Research Disclosure, Kenneth Mason Publications, Hampshire, GB Nov. 1, 1995, pp. 739-740.

*Primary Examiner*—John Sipos
(74) *Attorney, Agent, or Firm*—Venable LLP; Robert Kinberg; Catherine M. Voorhees

(57) ABSTRACT

A novel and improved method of applying adhesive to one side of a running web of wrapping material for a rod-like filler of filter material for tobacco smoke includes directing toward the one side of the web a stream of adhesive which issues from an open-and-shut orifice of a nozzle, and employing one or more jets of compressed air to vary the direction of flow of the stream so that the adhesive coats one marginal portion as well as the adjacent portion of the major central part of the one side and forms at least one non-linear layer. Once the thus treated web is draped around the filler, the adhesive bonds the two marginal portions of the converted web to each other and simultaneously bonds the central part of the web to the filler.

14 Claims, 4 Drawing Sheets

U.S. PATENT DOCUMENTS 5,060,664 A * 10/1991 Siems et al. ..... 131/84.1
5,125,008 A 6/1992 Trawick et al.
5,135,008 A 8/1992 Oesterling et al.
5,226,432 A * 7/1993 Pollentzke et al. ..... 131/69
5,234,397 A * 8/1993 Wahle et al. ..... 493/4
5,292,068 A * 3/1994 Raterman et al. ..... 239/11
5,531,233 A 7/1996 Oglesby et al.
5,580,405 A * 12/1996 Palmer ..... 156/73.1
6,311,899 B1 * 11/2001 Hidaka et al. ..... 239/298
6,325,853 B1 * 12/2001 Hogan et al. ..... 118/300
6,409,646 B1 * 6/2002 Focke et al. ..... 493/7

FOREIGN PATENT DOCUMENTS

DE 692 00 277 11/1994
EP 0 541 960 A1 5/1993
GB 1 305 023 1/1973
GB 1 305 023 A 1/1973

* cited by examiner

METHOD OF AND APPARATUS FOR APPLYING ADHESIVE TO RUNNING WEBS OF PAPER AND THE LIKE

CROSS-REFERENCE TO RELATED CASES

This application claims the priority of the commonly owned copending German patent application Serial No. 100 27 955.4 filed Jun. 8, 2000. The disclosure of such German patent application, as well as that of each U.S. and/or foreign patent and patent application identified in the specification of the present application, is incorporated herein by reference.

BACKGROUND OF THE INVENTION

The invention relates to improvements in methods of and in apparatus for applying flowable substances to running webs or strips of wrapping material in rod making machines, especially in rod making machines of the tobacco processing industry. Typical examples of such machines are so-called filter rod making machines which serve to make continuous rods of wrapped filter material for tobacco smoke. The rod is subdivided into filter rod sections of unit length or multiple unit length which can be fed to a so-called tipping machine wherein the filter rod sections are assembled with cigarette-, cigar- or cigarillo rod sections to form therewith filter cigarettes, cigars or cigarillos of unit length or multiple unit length.

Filter rod making machines are disclosed, for example, in U.S. Pat. No. 3,974,007 granted Aug. 10, 1976 to Greve for "METHOD AND APPARATUS FOR THE PRODUCTION OF FILTER ROD SECTIONS OR THE LIKE", and in U.S. Pat. No. 4,412,505 granted Nov. 1, 1983 to Häusler et al. for "APPARATUS FOR APPLYING ATOMIZED LIQUID TO A RUNNING LAYER OF FILAMENTARY MATERIAL OR THE LIKE". A filter tipping machine is disclosed, for example, in U.S. Pat. No. 5,135,008 granted Aug. 4, 1992 to Oesterling et al. for "METHOD OF AND APPARATUS FOR MAKING FILTER CIGARETTES".

Recent versions of apparatus for applying adhesive to running webs of wrapping material in filter rod making machines are constructed in such a way that one side of the running web of wrapping material for a rod-like filler of filter material (such as acetate fibers) for tobacco smoke is provided with two longitudinally extending films or layers or other accumulations of adhesive material, namely a first layer which is used to bond the overlapping marginal portions of the web to each other subsequent to draping of the web around successive increments of the running web around the filler, and a second layer which serves to bond the internal surface of the converted (tubular) web to the confined filler. Draping of the web around the rod-like filler is carried out in a wrapping apparatus which normally employs an endless belt (called garniture) serving to convert a running flat web or strip of cigarette paper or the like into a tubular envelope surrounding the filler. Adhesive applying apparatus of the just outlined character are disclosed, for example, in German patent application Serial No. 31 43 526 A of Vaughan (published Jun. 9, 1982) and in British patent No. 1 305 023 granted Jan. 31, 1973 to Molins Machine Company Limited.

A drawback of the conventional adhesive applying methods and apparatus is that the adhesive substance often penetrates through the web of wrapping material and contaminates those portions of a filter rod making or filter tipping machine which come into contact with the adhesive.

Moreover, the adhesive at the outer side of the tubular envelope affects the appearance of the filter cigarette, cigar or cigarillo and renders it necessary to segregate such smokers' products from acceptable smokers' products.

The likelihood of penetration of adhesive (such as a hotmelt) through the web is especially pronounced if the adhesive is applied to one side of a foraminous web, e.g., a web which has been perforated on purpose in order to permit atmospheric air to penetrate into the mouthpiece of a filter cigarette or the like and to mix with tobacco smoke flowing from the lighted end of a filter cigarette or the like into the mouth of a smoker. Apparatus which can be utilized to perforate the webs of wrapping material for rod-shaped cigarette fillers or filter rod fillers are disclosed, for example, in U.S. Pat. No. 4,281,670 granted Aug. 4, 1981 to Heitmann et al. for "APPARATUS FOR INCREASING THE PERMEABILITY OF WRAPPING MATERIAL FOR ROD-SHAPED SMOKERS' PRODUCTS", and in U.S. Pat. No. 4,889,140 granted Dec. 26, 1989 to Lorenzen et al. for "APPARATUS FOR MAKING PERFORATIONS IN ARTICLES OF THE TOBACCO PROCESSING INDUSTRY".

In fact, an adhesive substance which has been applied to one marginal portion of a running web of cigarette paper in a cigarette rod making machine is likely to penetrate through the tubular envelope of the plain cigarette as well as through the tubular envelope which is made of so-called tipping paper and serves to connect a plain cigarette with a filter mouthpiece, e.g., in a manner as disclosed, for example, in the aforementioned U.S. Pat. No. 5,125,008 to Oesterling et al. The adhesive which has penetrated through the cigarette paper as well as through the tipping paper is likely to contaminate the tipping machine and to necessitate segregation of numerous filter cigarettes between the maker of such products and the packing machine.

OBJECTS OF THE INVENTION

An object of this invention is to provide a novel and improved method of applying a flowable adhesive to running webs of cigarette paper, tipping paper or the like.

Another object of the present invention is to provide a method which reduces the likelihood of penetration of flowable adhesive from one side to the other side of a web or strip of paper or the like during and subsequent to the application of adhesive to the one side of the web.

A further object of the invention is to provide a method which renders it possible to achieve substantial savings in adhesive without affecting the quality of the bonding action.

An additional object of the invention is to provide a method of regulating the quantity of applied adhesive as a function of at least one variable parameter which influences the quality of the bond between cigarette paper, tipping paper or the like and a rod of filamentary material of the type being processed in connection with the making of rod-shaped products.

Still another object of the invention is to provide a novel and improved apparatus for the practice of the above outlined method.

A further object of the instant invention is to provide a novel and improved method of making filter mouthpieces for tobacco smoke.

Another object of the present invention is to provide a novel and improved method of making filter cigarettes, cigars, cigarillos and analogous smokers' products.

An additional object of the invention is to provide a method of applying a hotmelt or another suitable adhesive to running webs of paper or the like in such a way that the applied adhesive can serve to bond the adhesive-carrying component to one or more different parts, for example, to itself and to a rod-like filler of filamentary filter material for tobacco smoke.

Still another object of the invention is to provide a novel and improved method of applying adhesive to running webs of cigarette paper, tipping paper or the like in a highly economical manner without risking the establishment of a weak or otherwise unsatisfactory connection between the adhesive-bearing part and one or more additional parts.

A further object of the invention is to provide the apparatus for the practice of the above outlined method with one or more novel and improved nozzles or analogous implements for the application of adhesive to a running web of cigarette paper or the like.

An additional object of the present invention is to provide the apparatus with novel and improved means for regulating the rate of admission of adhesive into the nozzle as well as the direction or directions of discharge of adhesive from the nozzle.

SUMMARY OF THE INVENTION

One feature of the present invention resides in the provision of a method of applying a flowable substance (such as a hotmelt or another suitable adhesive) to a web of wrapping material for rod-shaped products, e.g., to a web of cigarette paper or tipping paper which is utilized for the making of filter mouthpieces or filter cigarettes. The method comprises the steps of confining the web to movement along a predetermined path (e.g., from a bobbin to a wrapping mechanism in a filter rod making machine), directing at least one stream of flowable substance toward one side of the web in the predetermined path, and moving the at least one stream relative to the path to provide the web with an at least partially non-linear layer of flowable substance.

The directing step can involve the utilization of a nozzle having an orifice which discharges the at least one stream of flowable substance, and the moving step can include rotating the stream. Such rotating step can include directing against the stream at least one flow of a fluid substance, e.g., compressed air.

In accordance with a presently preferred undertaking, the stream directing step includes imparting to the stream the shape of a hollow cone having an apex in line with the orifice of the nozzle. The flow directing step of such method can include causing the flow to impinge upon the stream of flowable substance at an acute angle, preferably at an angle which equals or approximates 30°. The flow is or can be at least substantially tangential to the cone.

The flow directing step can include causing the fluid substance to flow along a preselected path prior to and during issuance of the stream of flowable substance from the orifice of the nozzle.

The method can further comprise the steps of pumping the flowable substance from a source to the orifice of the nozzle at a variable pressure, and providing an electromagnetic valve or another suitable open-and-shut closure for the orifice of the nozzle. The pumping step can include raising the pressure of the flowable substance to a predetermined value prior to opening of the orifice, and such opening of the orifice can take place subsequent to (e.g., approximately 0.5 second following) the raising of the pressure of flowable substance to the predetermined value.

The method further comprises the step of advancing the web lengthwise along the predetermined path at a variable speed during the carrying out of the stream directing and stream moving steps. Such method can also comprise the step of discharging the flowable substance from the orifice of the nozzle at a rate which is a function of the speed of advancement of the web along the predetermined path. The step of discharging the flowable substance can include varying the rate of discharge of flowable substance proportionally with variations of the speed of the web. In such method, the step of discharging the flowable substance can include discharging such substance from the orifice at a rate of at least two grams per minute.

The non-linear layer can constitute a spiral layer.

Another feature of the present invention resides in the provision of a method of making a filter for tobacco smoke. This method comprises the steps of advancing a tow of filter material for tobacco smoke along a first path, advancing a web of wrapping material lengthwise along a second path toward and into the first path, applying to one side of the web in the second path a non-linear layer of adhesive extending lengthwise of the web, and draping the adhesive-bearing web around the tow in the first path.

The applying step of the just discussed method can include applying adhesive to one of two marginal portions and to an intermediate portion of the web adjacent the one marginal portion, and the draping step of such method preferably includes bonding the marginal portions to each other and bonding the intermediate portion to the tow.

A further feature of the present invention resides in the provision of an apparatus for applying an adhesive substance to a running web of wrapping material for rod-shaped smokers' products. The improved apparatus comprises means for advancing the web lengthwise along a predetermined path, a nozzle which is adjacent a portion of the path and is set up to discharge a stream of flowable adhesive substance against one side of the web in the path, and means for varying the direction of propagation of the stream so that the adhesive which deposits on the web forms at least one non-linear layer.

The means for varying the direction of propagation of the stream of flowable adhesive substance can include means for directing against the stream of adhesive substance at least one jet of a gaseous fluid, e.g., several jets of compressed air.

The arrangement can be such that the aforementioned means for varying the direction of propagation of the stream includes means for imparting to the non-linear layer the shape of a spiral.

The novel features which are considered as characteristic of the invention are set forth in particular in the appended claims. The improved apparatus itself, however, both as to its construction and the modes of assembling and utilizing the same, together with numerous additional important and advantageous features and attributes thereof, will be best understood upon perusal of the following detailed description of certain presently preferred specific embodiments with reference to the accompanying drawings.

DESCRIPTION OF PREFERRED EMBODIMENTS

Figure 1:
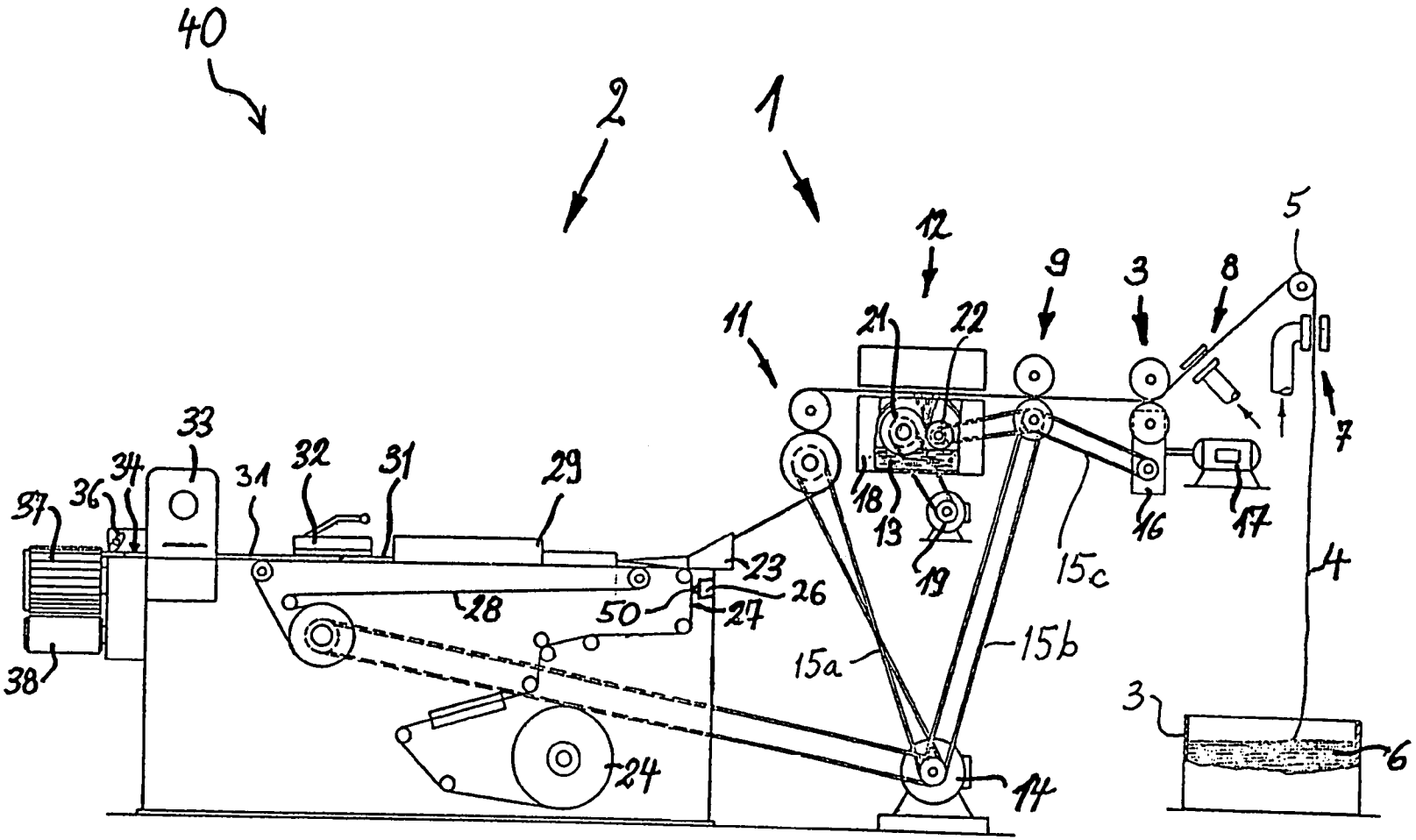
FIG. 1 is a schematic elevational view of a filter rod making machine wherein the running web of wrapping material for a processed rod-like tow of filter material for tobacco smoke is coated with adhesive in accordance with the method of the present invention.

FIG. 1 shows certain details of a filter rod making machine 40 of the type disclosed in the aforementioned U.S. Pat. No. 3,974,007 (Greve) and U.S. Pat. No. 4,412,505 (Häusler et al.). The machine 40 comprises a filter tow processing unit or section 1 and a filter rod making section or unit 2. The unit 1 includes a receptacle 3 for a bale 6 of a tow 4 of filamentary filter material (such as crinkled acetate fibers). The tow 4 is continuously pulled lengthwise by a pair of driven rolls 3 which cause successive increments of the tow to advance through a first so-called banding (tow spreading and loosening) device 7, around a deflecting roller 5, and through a second banding device 8 which is or which can be identical with the device 7. The rolls 3 are followed by two additional pairs of advancing rolls 9 and 11. The rolls 9 are driven at a peripheral speed exceeding that of the rolls 3 so that the filaments of the tow 4 are stretched between the rolls 3 and 9 to a degree selected by a variable-speed transmission 16 adjustable by a variable-speed electric motor 17.

The rolls 11 maintain the filaments of the tow 4 in stretched condition during advancement of successive increments of the tow through an atomizing apparatus 12 which sprays upon the filaments of the tow minute droplets of a suitable plasticizer, such as triacetin. The atomizing apparatus 12 comprises a vessel 18 for a supply 13 of liquid plasticizer. Such plasticizer is drawn from the vessel 18 by a roller 21 which is driven by a variable-speed motor 19 and cooperates with a driven rotary brush 22 to propel droplets of atomized plasticizer against the underside of the layer of substantially flat (stretched) filaments of the tow 4 between the driven rolls 9 and 11.

The rolls of the pair 9 and/or 11 are preferably designed in such a way that one thereof is provided with a smooth peripheral surface surrounding an elastic cylinder and the other is provided with circumferentially complete peripheral grooves, not shown.

The pairs of rolls 3, 9 and 11 receive motion from a main prime mover 14 (such as a variable-speed electric motor) by way of endless belts or chains 15*a*, 15*b*, 15*c*. The belt 15*a* drives the lower roll 11, the belt 15*b* directly drives the lower roll 9, and the belt 15*c* transmits torque between the lower roll 9 and the input element of the variable-speed transmission 16.

Successive increments of the spread-out and plasticizer-bearing tow 4 are fed into a so-called gathering horn 23 which forms part of the unit 2 and converts the tow into a rod-like filler which is entrained by a web or strip 27 of cigarette paper or any other suitable wrapping material. The web 27 is drawn off a bobbin 24 or from another suitable source and is caused to advance past the orifice 52 (FIGS. 2 and 5) of a nozzle 50 on its way onto the upper reach or stretch of an endless belt (garniture) 28 forming part of a wrapping mechanism 29. The nozzle 50 forms part of an adhesive applicator 26 and is designed and operated in accordance with a feature of the present invention in a manner to be fully described hereinafter, especially with reference to FIGS. 2 and 5; it applies adhesive to one side of the running web 27, namely to the side which faces upwardly on its way into the wrapping mechanism 29.

Figure 3:
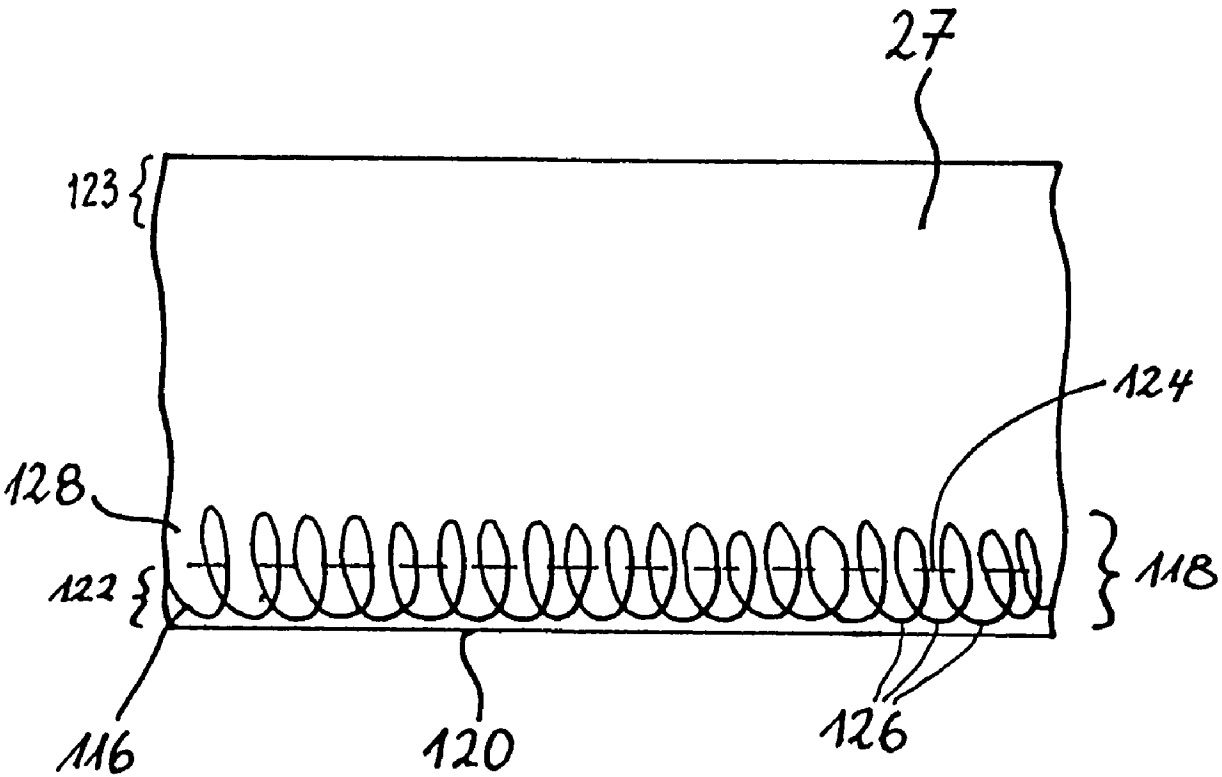
FIG. 3 is an enlarged fragmentary view of one side of the web and of the non-linear layer or pattern established by the adhesive at the one side of the web.
Figure 4:
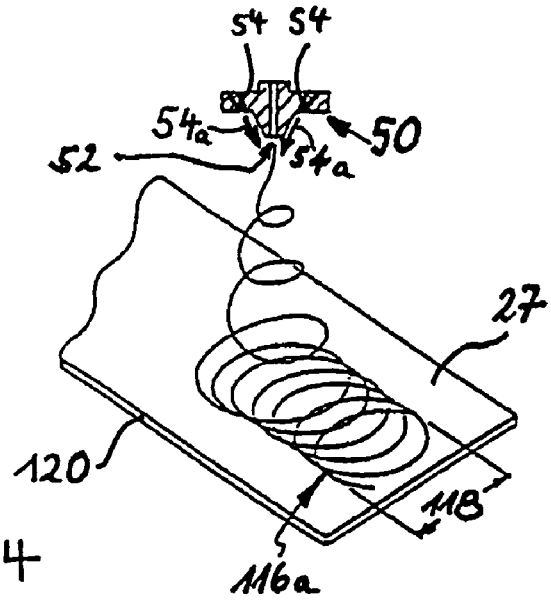
FIG. 4 is a second enlarged fragmentary view of one side of the web and of the non-linear layer or pattern and of the nozzle.

The manner in which a spiral layer 116 of adhesive is applied to one side of the running web 27 of cigarette paper or another suitable wrapping material for the tow 4 of filter material issuing from the gathering horn 23 is shown in FIGS. 3 and 4. The layer 116 has a width 118 which exceeds the width of one marginal portion 122 at the edge 120 of the running web 27. Thus, a substantial part of the layers 116 or 116*a* are applied to a part 128 of the major central or intermediate portion of the adhesive-bearing surface or side of the web 27. This means that, when the wrapping mechanism 29 completes the conversion of successive increments of the web 27 into a tubular envelope which surrounds the rod-like filler of filamentary filter material issuing from the gathering horn 23, the adhesive-bearing marginal portion 122 of such web overlies and adheres to the other marginal portion 123, whereas the portion 128 of the adhesive layer 116 adheres to the adjacent filaments of the converted tow. The broken line 124 in FIG. 3 represents the imaginary boundary between the adhesive bearing surface of the marginal portion 122 and the adjacent adhesive-bearing part 128 of the surface between the marginal portions 122, 123. The partially overlapping convolutions of the illustrated spiral layer 116 are shown at 126 in FIG. 3.

Referring again to FIG. 1, the continuous filter rod 31 issuing from the wrapping mechanism 29 advances past a sealer 32 which causes the applied adhesive of the layer 116 to set. The sealer 32 can be arranged to cool the seam defined by the overlapping marginal portions 122, 123 of the converted web 27 if the adhesive of the layer 116 is a hotmelt. A cutoff 33 serves to repeatedly cut across the leader of the rod 31 to thus separate from the rod sections or mouthpieces 34 of unit length or multiple unit length. Successive mouthpieces 34 are propelled lengthwise by a rotary accelerating cam 36 which causes discrete mouthpieces to enter successive axially parallel peripheral flutes of a drum-shaped transfer conveyor 37. The latter attracts the mouthpieces 34 by suction and deposits them on the upper reach of an endless belt conveyor 38 which serves to deliver mouthpieces sideways into the magazine of a tipping machine, e.g., a filter cigarette making machine of the character disclosed in the aforementioned U.S. Pat. No. 5,135,008 to Oesterling et al.

Figure 2:
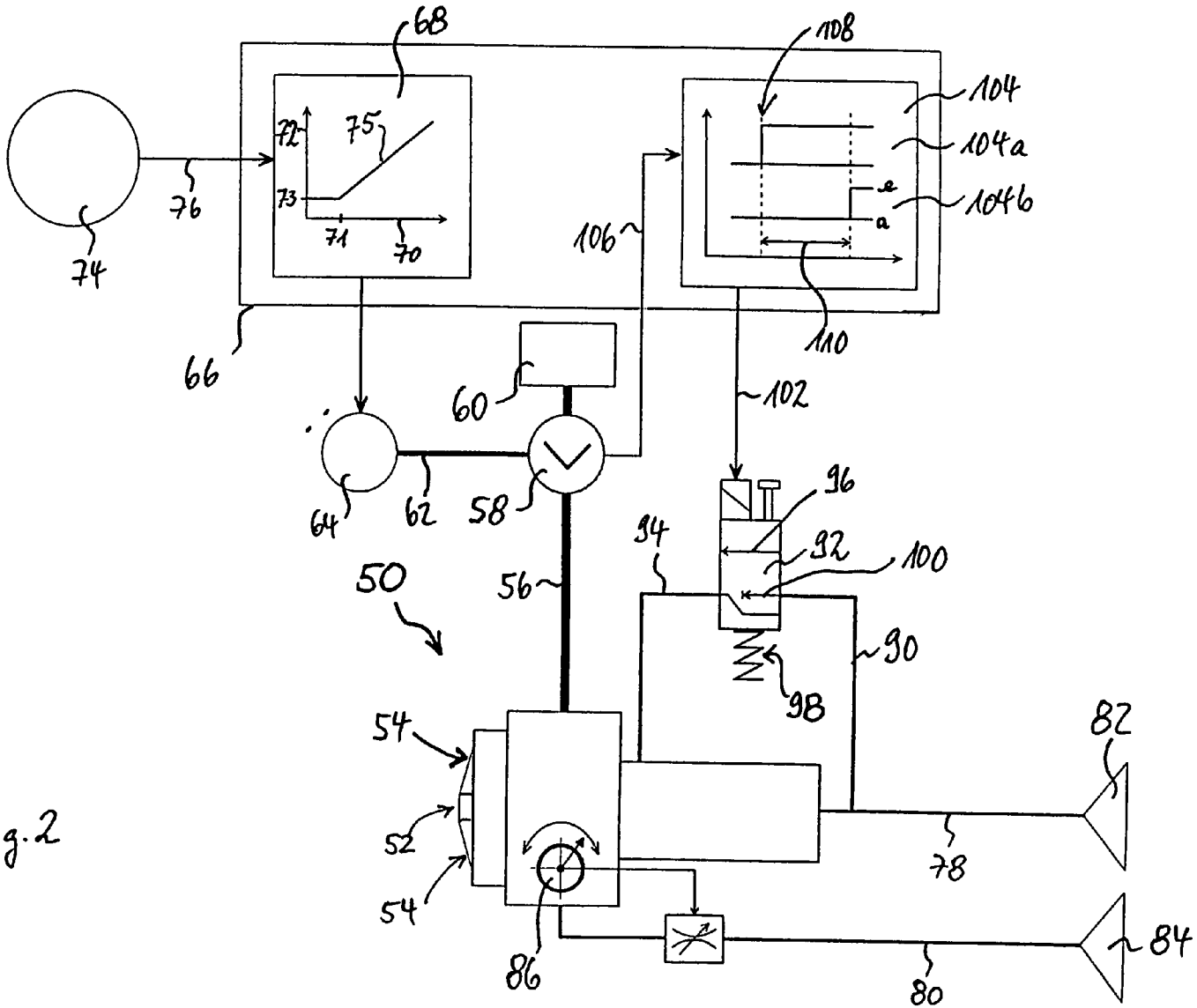
FIG. 2 is a diagrammatic view of the controls for the nozzle which is employed to discharge a stream of adhesive against one side of the running web.
Figure 5:
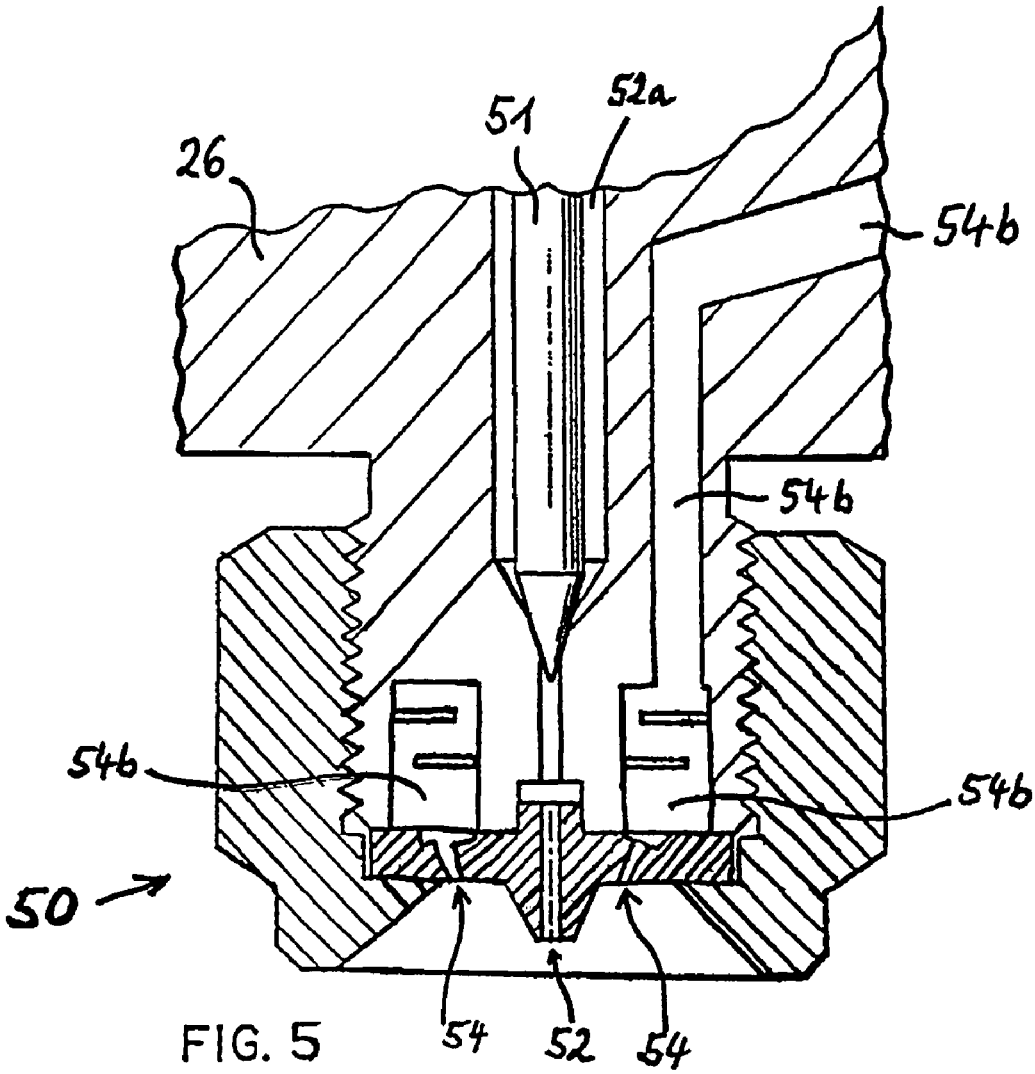
FIG. 5 is an enlarged fragmentary cross-sectional view of the nozzle and the needle used in the nozzle.

FIGS. 2 and 5 illustrate in greater detail the aforementioned nozzle 50 which applies the spiral layer 116 of adhesive to the marginal portion 122 and to the adjacent portion 128 of one side of the web 27 (FIGS. 3 and 4) running along the path extending from the bobbin 24 to the wrapping mechanism 29 (FIG. 1). The nozzle 50 has an adhesive-discharging orifice 52 connected with a conduit 52*a* for receiving the adhesive substance. The orifice 52 is flanked or surrounded by air-discharging outlets or ports 54 serving to discharge jets or flows of a gaseous fluid (preferably compressed air) which influences the direction of discharge of adhesive through the orifice 52*. The nozzle 50 can resemble that disclosed in the U.S. Pat. No. 5,194,115 to Ramspeck et al. This patent discloses an apparatus which is designed to deposit overlapping loops of an adhesive bead upon a substrate which is to be used in the making of diapers.

*The ports 54 receive a suitable amount of air via a conduit 54*b*.

The orifice 52 of the nozzle 50 shown in FIGS. 2, 4 and 5 receives via conduit 52*a* a suitable flowable adhesive substance from an adjustable pump 58 by way of a conduit 56 connected to the conduit 52*a*. The pump 58 draws adhesive from a source 60. The character 62 denotes a conductor arranged to transmit to the pump 58 signals from a control unit 64 which is set up to regulate the operation of the pump in accordance with a predetermined program. This is shown schematically in the upper portion of FIG. 2 which illustrates a screen 66 with two graphs 68 and 108.

In the coordinate system of the graph 68, the speed of forward movement of the web 27 in its predetermined path extending past the nozzle 50 is measured along the abscissa 70, and the quantity of adhesive being discharged by the pump 58 is measured along the ordinate 72. A sensor 74 is provided to furnish to the control unit 64 signals denoting the speed of lengthwise movement of the web 27. The control unit 64 processes the information furnished by the sensor 74 via conductor 76 in a manner as denoted by the curve in the coordinate system of the graph 68.

The pump 58 is caused to deliver to the nozzle 50 a predetermined minimal quantity of adhesive even when the speed of forward movement of the web 27 is zero. This is shown at 73. The quantity of adhesive being supplied by the pump 58 increases proportionally with increasing speed of the web 27 when the latter is set in motion and is accelerated to its standard speed. This is denoted by the upwardly sloping portion of the curve 75 in the coordinate system of the graph 68. The rate of admission of adhesive begins to increase when the speed of forward movement of the web 27 increases from zero to the value 71 on the abscissa 70 of the coordinate system of the graph 68. The relationship between the increasing speed of the web 27 and the increasing quantity of adhesive being supplied by the pump 58 becomes and remains linear as soon as the speed of the web 27 reaches and thereupon exceeds the lower (threshold) value shown at 71.

The ports 54 of the nozzle 50 communicate via the conduit 54*b* with an air pump 84 by way of a conduit 80, and a second air pump 82 establishes a pressure of 5 bar in a conduit 78. The air pump 84 is arranged to maintain the body of air in the conduit 80 at a pressure of 4 bar. The connection between the conduit 80 and the ports 54 includes a distributor 86. The latter distributes air being supplied by the conduit 80 to the ports 54 of the valve 50. The pressure of air streams flowing from the distributor 86 to the ports 54 is assumed to equal or approximate 65 mbar.

The pressure of air in the conduit 78 is utilized to seal or close the orifice 52 of the nozzle 50 by way of an element in the form of a reciprocable needle 51 or the like. The means for actually exposing or sealing the orifice 52 of the nozzle 50 includes an electromagnetic valve 92 which has an inlet for the application of pressure via conduit 90 branching off the conduit 78. A conduit 94 serves to apply fluid pressure prevailing in the conduit 90 to a second control surface of the valve 50 larger than a first control surface being acted upon by fluid in the conduit 80 via distributor 86.

The arrow 96 represents one condition or setting of the electromagnetic valve 92; such condition prevails when the air pump 82 supplies compressed air via conduits 78, 90 and the valve 92 establishes direct communication between the conduits 90 and 94, i.e., the pressure in the conduit 94 is then close to or exactly 5 bar. Such pressure of fluid in the conduit 94 causes the aforementioned needle 51 to expose the orifice 52. The reference character 98 denotes a resilient element (here shown as a coil spring) which can serve to induce the needle 51 to assume a retracted or inoperative position in which the orifice 52 of the valve 50 is open. As already mentioned hereinbefore, the exact construction of the nozzle 50 and the needle 51 is or can be identical with that of the nozzle disclosed in the U.S. Pat. No. 5,194,115 to Ramspeck et al.

When the valving element of the electromagnetic valve 92 assumes the position symbolized by the arrow 100, the valve 92 is closed so that the pressure of fluid in the conduit 94 drops to 0 bar. Since the effective area of the surface of the nozzle 50 which can be subjected to fluid pressure prevailing in the conduit 94 is larger than the effective area of the other surface, a drop of fluid pressure in the conduit 94 to zero bar entails an abrupt closing of the orifice 52 by the aforediscussed needle 51 or the like because the pressure of 5 bar prevailing in the conduit 78 then acts only upon the smaller effective surface. The closing of the nozzle 50 takes up a shorter interval of time than the opening; this ensures that any adhesive remaining in the orifice 52 of the nozzle 50 is expelled from such orifice 52 within a very short interval of time.

The electromagnetic valve 92 is operated in a manner as represented by the coordinate system in the graph 104 of the screen 66 shown in the upper part of FIG. 2. A conductor 106 transmits to the valve 92 signals denoting the output of the pump 58; such signals are transmitted to the valve 92 by conductor means 102. Time is measured along the abscissa of the coordinate system shown in the graph 104 of FIG. 2, and the output of the pump 58 is measured along the upper part of the ordinate, as at 104*a*. The lower part 104*b* is indicative of the condition of the electromagnetic valve 92. The character e denotes the energized condition of the valve 92, i.e., the valve 92 is open as indicated by the arrow 96 (this means that the conduit 90 communicates with the conduit 94). The character a denotes the closed condition of the valve 92 as indicated by the arrow 100.

The graph 104 depicts the actuation of the electromagnetic valve 92 during starting of the filter rod making machine 40 shown in FIG. 1. Thus, when the pump 58 is started (this is shown at 108 in the coordinate system of the graph 104), a certain interval 110 of time elapses before the electromagnetic valve 92 is switched from the closed condition a to the energized condition e. The duration of the interval 110 can be in the range of 0.5 second. Such delay ensures that the orifice 52 is still sealed by the aforediscussed needle 51 or the like, i.e., that the pressure of adhesive rises before the needle 51 is retracted from the orifice 52 by the electromagnetic valve 92. The pressure of adhesive is raised by the running pump 58. The orifice 52 is exposed when the condition of the valve 92 changes from that denoted by the arrow 100 to that denoted by the arrow 96.

The stream of adhesive issuing from the orifice 52 of the nozzle 50 begins to flow against the running web 27 at a predetermined rate as soon as the needle 51 is withdrawn by the valve 92. In the illustrated embodiment, the rate of flow of adhesive from the orifice 52 is assumed to equal or approximate 2 grams per minute.

Irrespective of the condition of the electromagnetic valve 92, the air pressure prevailing in the conduit 80 is continuously applied at the ports 54. This ensures that the ports 54 can discharge rotation-imparting air jets or flows as soon as the adhesive begins to issue from the orifice 52. The air jets rotate the stream of adhesive issuing from the orifice 52 to thus ensure that the stream of adhesive impinging upon the running web 27 is deposited in a non-linear pattern, such as in manner shown at 116 in FIG. 3 or in a manner shown at 116*a* in FIG. 4, while the web 27 advances past the orifice 52.

The novel method ensures that, when the filter rod making machine 40 is started, the minimum quantity of adhesive (as described in connection with the graph 68 on the screen 66) and the delayed application of adhesive ejecting pressure (as represented by the coordinate system in the graph 104) enable the improved machine to operate highly satisfactorily through numerous consecutive shifts, i.e., without any disturbances. Experiments evidence that the operation of the nozzle-pump combination 50, 58 was satisfactory through 20 consecutive shifts.

An advantage of the improved method and apparatus is that, owing to non-linear application of adhesive (such as at 116) to one side of the running web 27, the distribution of adhesive on such side is much more satisfactory than the heretofore known and customary applications of straight wide or narrow strips or bands of adhesive along the entire side of one marginal portion of the web and along the adjacent portion of the major central or median part of such web.

An advantage of the novel distribution of adhesive at one side of the running web is that the adhesive is less likely to penetrate through the web 27 and contaminate the web advancing and web draping parts of the machine 40 and/or the parts of a machine (such as a filter tipping machine) which receives filter rod sections 34 from the conveyor 38 of the machine 40 shown in FIG. 1.

Another advantage of the application of a non-linear layer of adhesive, e.g., of a spiral layer 116 of the types shown in FIG. 3 or in FIG. 4, is that the width 118 of the layer can be selected and varied in a simple and reliable manner such as by altering the directions and/or velocities of the jets or flows of air which issue from the ports 54 to impinge (tangentially or otherwise) upon the normally hollow conical stream (See FIG. 4) of adhesive issuing from the orifice 52 of the nozzle 50.

An additional important advantage of the improved method and apparatus is that the width 118 of the spiral layers 116 or 116*a* (or an equivalent non-linear layer) can be readily selected in a manner to exceed the width of one marginal portion 122 of the web, i.e., the width of that marginal portion which is bonded to the other marginal portion 123 when the conversion of the web 27 into the tubular wrapper or envelope of the finished filter rod 31 is completed. The excess width (128) of the spiral layer 116 is utilized to bond the tubular envelope (converted web 27) to the rod-like filler (converted tow 4) of the filter rod 31. Thus, it is no longer necessary to apply at least two adhesive layers, namely at least one first layer to one marginal portion and at least one second layer to the median portion of the running web. Reference may be had to the aforementioned British patent No. 1 305 023 to Molins (this patent proposes to apply a total of four linear layers of adhesive) and to the aforementioned published German patent application Serial No. 31 43 526 A1 which proposes the application of two discrete linear strips of adhesive. The application of a single layer for bonding two spaced-apart (marginal) portions (122, 123) of the web 27 to each other as well as for bonding the portion 128 to the rod-like filler of filter material entails savings in equipment and in adhesive without affecting the quality of the ultimate product (31).

As already mentioned hereinbefore, the nozzle 50 can be designed in such a way that its orifice 52 discharges adhesive which forms a hollow cone (FIG. 4) with the apex located on the imaginary extension of or at the orifice 52. The jets or flows of air issuing from the ports 54 cause the stream of adhesive to rotate. The jet or jets of air can impinge upon the stream of adhesive at an acute angle, particularly at an angle of 30° or thereabout (See arrows 54*a* in FIG. 4), preferably tangentially of the conical adhesive stream. Such selection of configurations of the adhesive steam and of the air flow or flows is desirable and advantageous because it renders it possible to provide the web 27 with a non-linear adhesive layer (such as the spiral layers 116 or 116*a* shown in FIG. 3 or FIG. 4) in a surprisingly simple and reliable manner.

The air flow or flows can be established and properly oriented relative to the future path of the adhesive stream before the orifice 52 of the nozzle 50 begins to discharge a conical (FIG. 4) or an otherwise configurated stream of adhesive. This is advisable because such undertaking ensures that, when the machine 40 is being started, the issuing adhesive stream is immediately set in rotary motion, i.e., the application of a non-linear layer (such as 116 or 116*a*) begins as soon as the valve 92 retracts the aforediscussed needle 51 or the like from orifice 52 of the nozzle 50. Thus, the application of adhesive to the web 27 begins and thereupon proceeds in such a way that the developing non-linear layer (such as 116 or 116*a*) is unlikely to penetrate through the running web 27. Therefore, the machine 40 is less likely to turn out a substantial number of rejects (i.e., unsatisfactory filter rod sections 34) during the initial stage of its operation following a shorter or longer stoppage.

The aforementioned needle 51 or the like can be withdrawn from the orifice 52 of the nozzle (or from a position in which it obstructs the flow of adhesive into even though it is not actually located in the nozzle) with a predetermined delay after the pressure of adhesive in the conduit 56 (i.e., at the outlet of the pump 58) reaches a predetermined minimum acceptable value, e.g., with a delay of 0.5 second. Such mode of operation ensures that the machine 40 turns out satisfactory filter mouthpieces 34 at each of a range of different operating speeds. This is further ensured if, in accordance with an additional important feature of the present invention, the quantity of adhesive being supplied by the pump 58 per unit of time is in proper proportion to (i.e., is a function of) the speed of advancement of the web 27 along its path from the bobbin 24 to the wrapping mechanism 29. As already mentioned hereinbefore, the minimum quantity of adhesive is preferably within a certain range including 2 grams per minute. Such minimum quantity of adhesive can be applied to the web 27 when the forward speed of the web 27 drops below a preselected minimum speed. This ensures that the web 27 (or an equivalent thereof) receives adequate quantities of adhesive during each stage of operation of the machine 40, i.e., also during starting and during subsequent acceleration of the machine to the normal speed or to one of a range of acceptable (normal) speeds.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the above outlined contribution to the art of applying adhesive to running webs or strips of paper and the like and, therefore, such adaptations should and are intended to be comprehended within the meaning and range of equivalence of the appended claims.

What is claimed is:

1. A method of applying a flowable substance to a web of wrapping material for rod-shaped products of the tobacco industry, the method comprising the steps of:

confining the web to movement along a predetermined path;

directing at least one stream of flowable substance along the predetermined path in an at least partially non-linear manner toward one side of the web, wherein said directing step includes the utilization of a nozzle having an orifice which discharges the at least one stream of flowable substance, and includes rotating the stream, wherein said rotating step includes directing against the stream at least one flow of a fluid substance;

advancing the web lengthwise along said path at a variable speed; and discharging the flowable substance from the orifice at a directly proportional rate which is a function of the speed during said directing step of advancement of the web along said predetermined path wherein increase and decrease in the speed of the web increases and decreases, respectively, the rate of the discharging of the flowable substance.

2. The method of claim 1, wherein the fluid substance is air.

3. The method of claim 1, wherein said stream directing step includes imparting to the stream the shape of a hollow cone having an apex in line with the orifice of the nozzle.

4. The method of claim 3, wherein said flow directing step includes causing the flow to impinge upon the stream at an acute angle.

5. The method of claim 4, wherein said angle at least approximates 30°.

6. The method of claim 4, wherein said flow is substantially tangential to said cone.

7. The method of claim 1, further comprising the steps of pumping the flowable substance from a source to the orifice of the nozzle at a variable pressure and providing an open-and-shut closure for the orifice.

8. The method of claim 7, wherein said pumping step includes raising the pressure of the flowable substance to a predetermined value prior to opening of the orifice.

9. The method of claim 8, wherein the opening of the orifice takes place approximately 0.5 second subsequent to raising of the pressure of flowable substance to said predetermined value.

10. The method of claim 1, wherein said step of discharging the flowable substance includes varying the rate of discharge of flowable substance proportionally with variations of the speed of the web.

11. The method of claim 1, wherein said step of discharging the flowable substance includes discharging the flowable substance from the orifice at a rate of at least 2 grams per minute.

12. The method of claim 1, wherein the non-linear layer is a spiral layer.

13. The method of claim 1, wherein the flowable substance is an adhesive.

14. The method of claim 1, wherein said flow directing step includes causing the fluid substance to flow along a preselected path prior to and during issuance of the stream from the orifice of the nozzle.

* * * * *